US005162061A

United States Patent [19]

Sternhamn

[11] Patent Number: 5,162,061

[45] Date of Patent: Nov. 10, 1992

[54] DEVICE FOR INTRODUCING LIQUID COMPOSITION INTO THE PIPES FORMED BY FLUTES OF CORRUGATED CARDBOARD SHEETS

[76] Inventor: Nils-Ake Sternhamn, Leksbergsvägen 41, S-542 44 Mariestad, Sweden

[21] Appl. No.: 720,536

[22] PCT Filed: Dec. 20, 1989

[86] PCT No.: PCT/SE89/00742

§ 371 Date: Jun. 25, 1991

§ 102(e) Date: Jun. 25, 1991

[87] PCT Pub. No.: WO90/07617

PCT Pub. Date: Jul. 12, 1990

[30] Foreign Application Priority Data

Dec. 29, 1988 [SE] Sweden ..... 8804698

[51] Int. Cl.[5] ..... B05B 13/06

[52] U.S. Cl. ..... 118/676; 118/696; 118/38; 118/215; 118/317; 118/DIG. 10; 156/531; 156/210; 156/470

[58] Field of Search ..... 118/676, 696, 38, 215, 118/317, DIG. 10; 156/530, 531, 532, 210, 470

[56] References Cited

U.S. PATENT DOCUMENTS

| | | | |
|---|---|---|---|
| 1,592,824 | 7/1926 | Fairchild | 156/280 |
| 3,669,064 | 6/1972 | Heolzinger et al. | 118/50 |
| 3,669,067 | 6/1972 | Achermann et al. | 118/50 |
| 3,695,219 | 10/1972 | Arian et al. | 118/317 |
| 3,842,795 | 10/1974 | Lau et al. | 118/317 |
| 3,858,550 | 1/1975 | Lau et al. | 118/317 |
| 3,892,763 | 7/1975 | Lau et al. | 118/317 |

*Primary Examiner*—W. Gary Jones
*Assistant Examiner*—Todd J. Burns
*Attorney, Agent, or Firm*—Sughrue, Mion, Zinn, Macpeak and Seas

[57] ABSTRACT

The device of the invention for introducing liquid composition into the pipes of corrugated cardboard sheets comprises at least one guide bar (3) having a guiding slot (4) for the top edges of the sheets being conveyed below the guide bar. Knives (8) are provided near the bottom edges of the slot. To cut loose narrow top edge areas of the exterior walls of the corrugated cardboard sheets from the adjacent pipe walls the edge areas constituting seals against the side walls of the slot exteriorly of the knives. Injector nozzles (13) open into the slot bottom for injecting composition into the pipes of the corrugated cardboard sheets. The vertical distance between the bottom of the guide bar slot and the conveyor is adjustable. The injectors are connected into a composition circulation circuit.

9 Claims, 1 Drawing Sheet

DEVICE FOR INTRODUCING LIQUID COMPOSITION INTO THE PIPES FORMED BY FLUTES OF CORRUGATED CARDBOARD SHEETS

BACKGROUND OF THE INVENTION

On account of its structure corrugated cardboard in relation to its weight has a great strength in resisting loads. Hence, corrugated cardboard is an extremely good material, e.g. for different types of packings, such as cases or containers. Corrugated cardboard also is potentially suitable as material for construction elements, and to a certain extent it has already been used for this purpose.

In the construction as well as in the packing industry corrugated cardboard is a particularly attractive material not only for its favourable ratio between strength and weight but also for its heat insulating capacity and its low cost, especially in relation to different kinds of wooden material, e.g. plywood. The latter factor progressively is becoming of greater and greater importance due to the increasing shortage of wooden fibre materials on the world market.

Corrugated cardboard also contains fibres, but the content of fibres in corrugated cardboard is very small in relation to the strength of corrugated cardboard. While this strength is great in relation to the weight of corrugated cardboard, the absolute strength of corrugated cardboard, however, is not sufficient for many areas of use, e.g. as material for construction elements. Therefor, since a long time a desired end has been a possibility of increasing the absolute strength of corrugated cardboard without increasing the fibre content thereof. Experiments to this end have been carried out, in that liquid compositions have been introduced into the pipes of the corrugated cardboard and caused to become deposited on the walls of the pipes to be absorbed thereby and hardened in situ to form a stiffening layer increasing substantially the strength of the corrugated cardboard. The introduction of the compositions in question into the pipes of the corrugated cardboard so far has been made by immersing the corrugated cardboard sheets into baths of the compositions. This procedure has several disadvantages. Thus the method involves hardening, drying and handling problems. Also, with this procedure it is difficult to prevent the composition in question from coating also the exterior faces of the corrugated cardboard sheets, which would mar the appearance of the sheets and which might prevent the application of other materials to the sheets, e.g. dye or water-repellants or materials preventing water from penetrating into the corrugated cardboard to weaken or destroy it. Also the method of causing a stiffening composition to be deposited on the interior walls defining the pipes by immersing the corrugated cardboard sheets into a bath of such a composition is a batch process. Of course, replacing such a batch process by a continuous process is desirable since a continuous process always means considerable savings in time and work and hence substantial cost savings, and obviously offers extremely favourable conditions for mass production as compared to batch processes. With the latter processes it is also difficult to closely control the feed of the compositions in question to allow the pipe walls to absorb neither more nor less than what is required to obtain the desired stiffening.

SUMMARY OF THE INVENTION

The purpose of the invention therefor is the provision of a device for feeding a liquid composition to the pipes of corrugated cardboard sheets in order to deposit the composition on the walls of the pipes and to have it absorbed thereby. By way of introduction, a hardenable composition capable of stiffening the pipe wall material has been discussed, but the device according to the invention is not limited to the use for supplying precisely this type of composition, but the device is also intended to be used for supplying other kinds of composition as well, e.g. impregnating compositions or compositions preserving against various kinds of biological destructive influence.

The device according to the invention eliminates the disadvantages of the prior art by making it possible to supply the material in question to the pipe walls without any risk of composition being applied to the exterior faces of the corrugated cardboard, and in closely controlled quantities, in a continuous process suited to mass production. These purposes are attained with the device for supplying liquid composition to the pipes of corrugated cardboard sheets according to the claims.

BRIEF DESCRIPTION OF THE DRAWINGS

An exemplary embodiment of the invention will be explained in more detail in the following description made with reference to the enclosed drawings, wherein.

DETAILED DESCRIPTION OF THE PREFERRED EMBODIMENT

Figure 1:
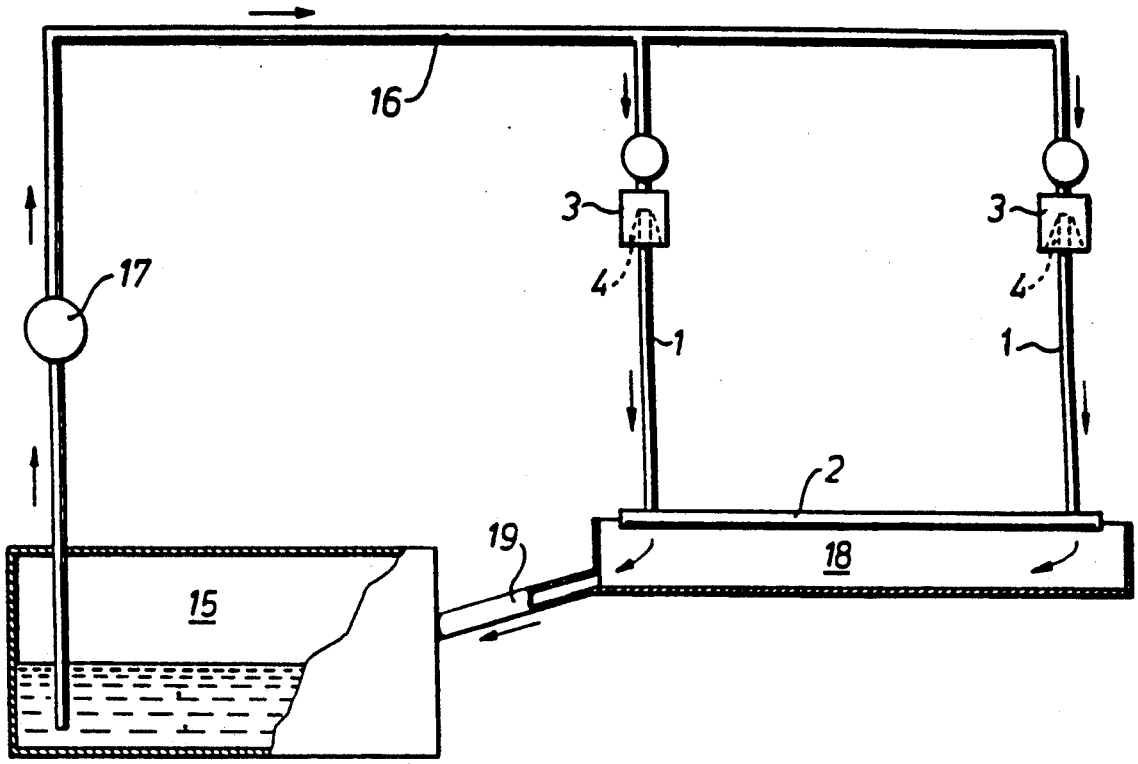
FIG. 1 is a diagram illustrating an arrangement for introducing liquid composition into corrugated cardboard pipes by means of the device of the present invention.

FIG. 1 shows two corrugated cardboard sheets 1 vertically disposed on a conveyor 2 adapted to transport the corrugated cardboard sheets 1 horizontally and in their own plane, i.e. in FIG. 1 at right angles to the plane of the paper.

Figure 2:
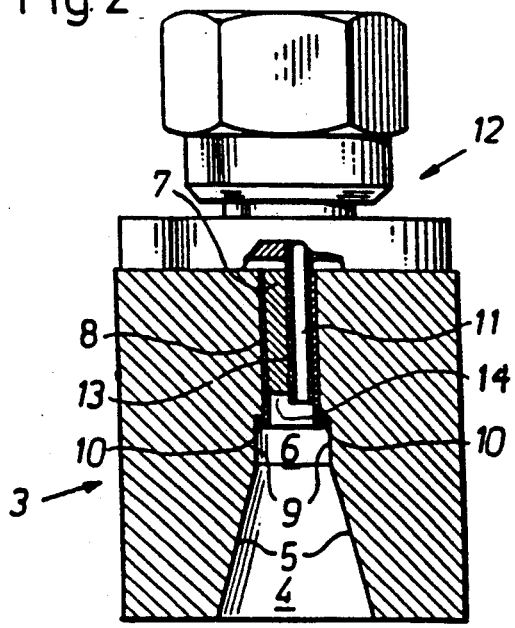
FIG. 2 is a vertical cross section through the guide bar of the device and showing an injector connection unit in elevation.

After having been placed on conveyor 2 and (in a manner not shown) made to be held in their vertical positions, the corrugated cardboard sheets 1 are moved by the conveyor 2 to the entrance ends of elongated guide bars 3 of arbitrary length. In the embodiment shown they have a rectangular outer cross section contour and an inner contour of generally the shape of an inverted downwardly opening V. The two legs of the V, however, do not meet directly, but are connected by a rectangular contour portion of the shape of an inverted U with vertical downwardly extending legs and a horizontal contour portion connecting the legs as shown by FIG. 2. Each guide bar 3 therefor has a substantially V-shaped slot 4 preferably symmetrical about the central plane thereof and opening downwardly and defined by lateral faces 5 converging from below and up, and a bottom portion 6 closing slot 4 at the top and having a rectangular cross section.

When corrugated cardboard sheets 1 are placed on conveyor 2, the distance between the bottoms of guide bars 3 and the top surface of conveyor 2 is somewhat larger than the height of corrugated cardboard sheets 1. Now, by conventional means not shown conveyor 2 may be raised or guide bars 3 lowered, or bars 3 and conveyor 2 are adapted to be moved towards each other until the distance between the top surface of conveyor 2 and each guide bar slot bottom corresponds to the height of corrugated cardboard sheets 1.

Bottom portion 6 of each guide bar slot has a horizontal dimension, i.e. width, corresponding to the thickness of corrugated cardboard sheets 1, so that the top edges of corrugated cardboard sheets 1 are closely guided in bottom portion 6 of slot 4, when, as explained in more detail below, corrugated cardboard sheets 1 are being moved along guide bars 3, but no closer than to allow the edges of corrugated cardboard sheets 1 to run along slot bottom portion 6 without appreciable friction against the lateral faces thereof, when corrugated cardboard sheets 1 are being moved by conveyor 2 along guide bars 3.

In the presently preferred embodiment of the invention, as corrugated cardboard sheets 1 being fed by conveyor 2 towards the ends of guide bars 3 are approaching the guide bar ends the distance between the bottom of guide bar slot 4 and the top surface of conveyor 2 is reduced gradually, so that when the leading front corner of corrugated cardboard sheets 1 enter the guide bar slot 4 the bottom thereof and the top edge of corrugated cardboard sheet 1 are at the same level, so that the top edge of corrugated cardboard sheet 1 from then on will move along the bottom of guide bar slot 4 with a suitable friction therewith and with a suitable pressure thereagainst. However, the distance between the guide bar slot bottom and the top surface of conveyor 2 need not be gradually reduced as corrugated cardboard sheets 1 are fed towards guide bars 3, but this distance may be reduced to the correct amount at the instant the corrugated cardboard sheets reach the ends of bars 3, under the control of a program controlling the device or by means effecting a reduction of the distance in response to signals from detector devices sensing the positions of corrugated cardboard sheets 1 with respect to guide bars 3.

Guide bars 3 have been described above as if they were one piece elements. However, in the preferred embodiment of the invention, they comprise two halves laterally separated by an elongated, rectangular rod 7 located between the halves and of a width that is slightly less than that of corrugated cardboard sheets 1 and of a height such that when rod 7 is placed between the two bar halves with its top surface flush with the top surface of the halves the bottom surface of rod 7 forms the larger part of the bottom portion of guide bar slot 6.

For a purpose to be explained in more detail below, an elongated knife 8 of a thickness of from about 0,1 to about 0,5, preferably about 0,3 mm, is located on each side of rod 7. Knives 8 with their predetermined height are located such, that they project into guide bar slots 4 by an amount of about 0,2–0,6, preferably about 0,4 mm. In the preferred embodiment each knife 8 extends along the whole length of bar 3, but each knife may also be divided into a number of shorter knives distributed along bar 3.

Now the two halves of guide bars 3 are made to have, in addition to each being provided with an inclined wall portion which in the assembled condition of the bar halves constitutes the oblique side faces 5 of slot 4 as well as a vertical wall portion 9 constituting, in the position of use, the lateral walls of bottom portion 6 of slot 4, a shoulder 10 having a width of a few tenths of a millimeter and projecting perpendicularly from the top edge of vertical wall portion 9 thus defining long and narrow inner edge areas of the bottom portion of slot 4. The dimensions are such that upon assembly of the two halves of guide bars 3, knives 8 and rod 7, e.g. by means of screw joints, in the manner shown by FIG. 2, slot bottom portion 6 obtains the width discussed above, knives 8 projecting into slot 4 by the amount indicated above and separated from the lateral faces of slot bottom portion 6 by amounts determined by the above-mentioned width of shoulders 10.

Rod 7 of each guide bar 3 is provided with several, in the position of use vertical through-holes 11. These are distributed along rod 7 and are located or distributed such in relation to the width dimension of slot bottom portion 6 as to be centered over the rows of pipes formed by the flutes of corrugated cardboard sheets 1 introduced into slot 4. Via an injector connection 12 each hole 11 is connected to a nozzle of an injector, or an injector nozzle 13 is inserted into each hole 11. The last-mentioned variant is the preferred one, and the lower end of nozzle 13 then projects somewhat into a recess 14 in the bottom face of rod 7. Recess 14 is an enlargement of the bottom end of hole 11. By letting nozzle 13 open in this manner into a recess of larger width than hole 11 so that nozzle 13 freely protrudes downwardly somewhat from the bottom of recess 14, a well-defined mouth edge is obtained, so that the composition to be injected into the corrugated cardboard sheets from the injector via nozzle 13 will be injected with a laminar flow substantially without any turbulence, which allows a more precise control of the injection of the composition into the pipes of corrugated cardboard sheets 1.

When corrugated cardboard sheets 1 are introduced into slots 4 of bars 3, their top edge portions will fit in slot portions 4 as described above. Obviously, the introduction thereof in slots 4 is facilitated by the V-shape of the latter. It is also immediately clear that as corrugated cardboard sheets 1 are being moved along guide bars 3 by conveyor 2 knives 8 will cut loose the top tenths of a millimeter of the side walls of corrugated cardboard sheets 1 from the adjacent walls of the pipes of the corrugated cardboard, so that the top edges of the side walls of corrugated cardboard sheets 1 will slide between the outer faces of knives 8 and side walls 9 of slot bottom portion 6 as corrugated cardboard sheets 1 are transported along the guide bars. For this reason the exterior faces of the top edges of corrugated cardboard sheets 1 will effectively seal against the interior faces 9 of slot bottom portion 6, so that composition injected into the pipes of the corrugated cardboard via nozzles 13 or holes 11 will be injected into the pipes without reaching the exterior faces of corrugated cardboard sheets 1.

The injectors may be of any suitable, conventional design, and therefor are not described in any detail here. They are provided in a number, with a distribution and with nozzle 13 (or hole 11) dimensions which are suitable with regard to such factors as the viscosity of the composition, the quantity of composition to be injected into the pipes of the corrugated cardboard, the intended injection rate etc.

FIG. 1 diagrammatically illustrates the flow circuit for the composition to be injected into the pipes of the corrugated cardboard. From a composition supply 15 located below the level of conveyor 2 the composition is pumped through a conduit 16 from supply 15 by means of a pump 17 in the conduit to the injectors by means of which the composition is injected into the pipes of the corrugated cardboard as explained above. Composition not absorbed by the walls of the corrugated cardboard pipes passes through the pipes to ducts, not shown, in conveyor 2 and via these ducts to a collecting vessel 18 below conveyor 2 but above the level of supply 15, and from this vessel 18 via a discharge conduit 19 from vessel 18 back to supply 15.

The described embodiment of the device according to the invention for introducing liquid composition into the pipes of corrugated cardboard can be modified and varied in many ways within the scope of the invention.

I claim:

1. A device for introducing liquid composition into pipes of corrugated cardboard sheets (1), comprising: at least one elongated guide bar (3) provided with a downwardly open slot (4), the width of a top portion (6) of said slot corresponding to the thickness of the corrugated cardboard sheets (1) and in which the corrugated cardboard sheets, while being moved in a vertical position along the guide bars, are guided by their top edges engaging a top of the slot, a plurality of holes (11) distributed along the guide bar and extending therethrough, the holes also being distributed across the width of the top of the slot in such a manner that a number of holes distributed along the guide bar are situated above each pipe row of the corrugated cardboard sheets introduced into the slot, a nozzle (13) inserted into each hole, each nozzle being connected to an injector for injecting composition into the pipes of the corrugated cardboard sheets via the hole and the nozzle, a knife (8) or several knives having two parallel blades, each blade distributed along the guide bar protruding slightly from the top of the slot, each blade being in close proximity to each lateral edge of the slot top so that as the corrugated cardboard sheets are moved into and along the guide bar the sides thereof are cut loose from adjacent pipe walls along a narrow area along their top edges, said area, as the sheets are being fed, sliding between the adjacent side wall (9) of the slot and the adjacent knife blade to form a seal against the side wall of the slot preventing composition from reaching the exterior faces of the corrugated cardboard sheets.

2. The device of claim 1, wherein each guide bar (3) is assembled from two lateral halves and a rod (7) is located therebetween, the holes (11) being provided in the rod, a bottom face of which constitutes a central portion of the top of the slot, each guide bar half having a narrow shoulder (10), a bottom face of which, upon assembly of the guide bar, is flush with the bottom face of the rod constituting continuations of the slot top, the knife blades being located on each side of the rod and between the rod and an adjacent guide bar half.

3. The device of claim 1 or 2, wherein the slot (4) of the guide bar (3) substantially has the shape of an inverted V, the side walls (9) of the top portion being substantially perpendicular to the top of the slot.

4. The device of claim 2, wherein free ends of the nozzles (13) project into recesses (14) provided in the rod at lower orifices of the holes.

5. The device of claim 1, wherein a conveyor (2) is located below the guide bar (3) or bars at a vertical distance from a bottom of each guide bar which corresponds to or is somewhat larger than the height of the corrugated cardboard sheets (1), the conveyor being adapted to feed into the entry end of each guide bar slot (4) corrugated cardboard sheets standing vertically on the conveyor and to move the sheets along the guide bars.

6. The device of claim 5, wherein each guide bar (3) and the conveyor (2) are relatively vertically adjustable to make the distance between each guide bar slot bottom and the conveyor correspond to the height of the corrugated cardboard sheets (1), so that the sheets will be moved along the guide bars with a predetermined pressure between each slot top and the top edges of the corrugated cardboard sheets.

7. The device of claim 6, wherein the spacing between the guide bar slot top and the conveyor is gradually reduced as the corrugated cardboard sheets (1) are fed to the entry ends of the guide bar slots (4), to an amount at which the said predetermined pressure between the slot top and the top edges of the corrugated cardboard sheets is obtained.

8. The device of claim 6, wherein at least one of the guide bars (3) and the conveyor (2) is adapted under the control of a program or actuated by actuating devices controlled by detectors detecting the positions of the corrugated cardboard sheets (1), to reduce the distance between the guide bar slot top and the conveyor to an amount at which the said predetermined pressure between the slot top and the top edges of the corrugated cardboard sheets is obtained and at the same time that the corrugated cardboard sheets (1) being fed to the entry ends of the guide bar slots (4) arrive at the entry ends.

9. The device of claim 1, wherein each injector is connected to a composition circulation circuit wherein liquid composition is circulated by a pump (17) in a conduit (16) from a composition supply (15) through the conduit to each injector, excess composition via the pipes of the corrugated cardboard sheets (1) reaching a collecting vessel (18) disposed below the corrugated cardboard sheets and above the level of the supply wherefrom the excess composition is carried to the supply through a discharge conduit (19) connecting the collecting vessel and the supply.

* * * * *